US008590988B2

(12) United States Patent
Liu

(10) Patent No.: US 8,590,988 B2
(45) Date of Patent: Nov. 26, 2013

(54) LOWER CORNER CABINET

(76) Inventor: Jack Liu, Taichung (TW)

( * ) Notice: Subject to any disclaimer, the term of this patent is extended or adjusted under 35 U.S.C. 154(b) by 262 days.

(21) Appl. No.: 13/228,530

(22) Filed: Sep. 9, 2011

(65) Prior Publication Data

US 2013/0063010 A1 Mar. 14, 2013

(51) Int. Cl.
*A47B 81/00* (2006.01)

(52) U.S. Cl.
USPC ..... 312/238; 312/258

(58) Field of Classification Search
USPC ..... 312/351, 205, 258, 262, 257.1, 238, 7.2
See application file for complete search history.

(56) References Cited

U.S. PATENT DOCUMENTS

| | | | | |
|---|---|---|---|---|
| 2,576,750 | A * | 11/1951 | Clark | 312/259 |
| 2,934,389 | A * | 4/1960 | Krey | 312/262 |
| 3,294,464 | A * | 12/1966 | Lew | 312/258 |
| 6,099,096 | A | 8/2000 | Lambright | 312/321.5 |
| RE37,943 | E * | 12/2002 | Domenig | 312/305 |
| 6,848,758 | B1 * | 2/2005 | Yeh et al. | 312/258 |
| 7,331,617 | B2 * | 2/2008 | Johnson | 292/202 |
| 8,333,444 | B1 * | 12/2012 | Chang | 312/262 |
| 2005/0067927 | A1 * | 3/2005 | Ho et al. | 312/258 |
| 2005/0174019 | A1 * | 8/2005 | Chi-Sheng | 312/258 |
| 2007/0210682 | A1 * | 9/2007 | Wise | 312/108 |
| 2008/0084149 | A1 * | 4/2008 | Ho | 312/258 |
| 2008/0164787 | A1 * | 7/2008 | Peng | 312/108 |
| 2013/0002112 | A1 * | 1/2013 | Liu | 312/262 |

* cited by examiner

*Primary Examiner* — Darnell Jayne
*Assistant Examiner* — Hiwot Tefera
(74) *Attorney, Agent, or Firm* — Alan Kamrath; Kamrath IP Lawfirm, P.A.

(57) ABSTRACT

A lower corner cabinet includes front and rear frames, front panel, first and second lateral panels, and a door panel. The rear frame is separated from the front frame. The front panel extends from the front frame. The first lateral panel includes an end pivotally joined to the front frame and another end pivotally joined to the rear frame and is foldable. The second lateral panel includes an end pivotally joined to the front panel and another end pivotally joined to the rear frame and is foldable. The bottom panel is selectively abutted against the front and rear frames and the first and second lateral panels and pivotally movable. The door panel extends from the front panel to the front frame. Moreover, the lower corner cabinet is operable in an extended position and a collapsed position and able to be changed therebetween without the aid of a tool.

15 Claims, 5 Drawing Sheets

LOWER CORNER CABINET

BACKGROUND OF THE INVENTION

1. Field of the Invention

The present invention relates to a lower corner cabinet and, in particular, to a lower corner cabinet that is operable in an extended position and a collapsed position and is able to be changed therebetween without the aid of a tool.

2. Description of the Related Art

U.S. Pat. No. 6,099,096 discloses a conventional corner cabinet. Like all other convention corner cabinets, the cabinet disclosed in U.S. Pat. No. 6,099,096 is not foldable to a smaller size. It is appreciated that the corner cabinet may be dissembled into parts for easy transportation. However, tools are usually required to disassemble the corner cabinet, and it is laborious and time consuming.

The present invention is, therefore, intended to obviate or at least alleviate the problems encountered in the prior art.

SUMMARY OF THE INVENTION

According to the present invention, a lower corner cabinet includes front and rear frames, front panel, first and second lateral panels, and a door panel. The rear frame is separated from and disposed behind the front frame. The front panel extends from and is disposed in front of the front frame. The first lateral panel extends from the front frame to the rear frame and includes an end pivotally joined to the front frame and another end pivotally joined to the rear frame and is foldable. The second lateral panel extends from the front frame to the rear frame and includes an end pivotally joined to the front panel and another end pivotally joined to the rear frame and is foldable. The first and second lateral panels are separated from each other. The bottom panel is selectively abutted against the front and rear frames and the first and second lateral panels. The bottom panel is pivotally movable. The door panel extends from the front panel to the front frame and is pivotally movable. The lower corner cabinet is operable in an extended position and a collapsed position and able to be changed therebetween without the aid of a tool. The lower corner cabinet includes a room including a periphery delimited by the front and rear frames as well as the first and second lateral panels. The lower corner cabinet positioned in the extended position includes the room having a first size. The lower corner cabinet positioned in the collapsed position includes the room having a second size. The second is size is smaller than the first size.

It is an object of the present invention to provide a lower corner cabinet operable in an extended position and a collapsed position.

It is a further object of the present invention to provide a lower corner cabinet operable in an extended position and a collapsed position and able to be changed therebetween without the aid of a tool.

Other objects, advantages, and new features of the present invention will become apparent from the following detailed description of the invention when considered in conjunction with the accompanied drawings.

DETAILED DESCRIPTION OF THE PREFERRED EMBODIMENT

Figure 1:
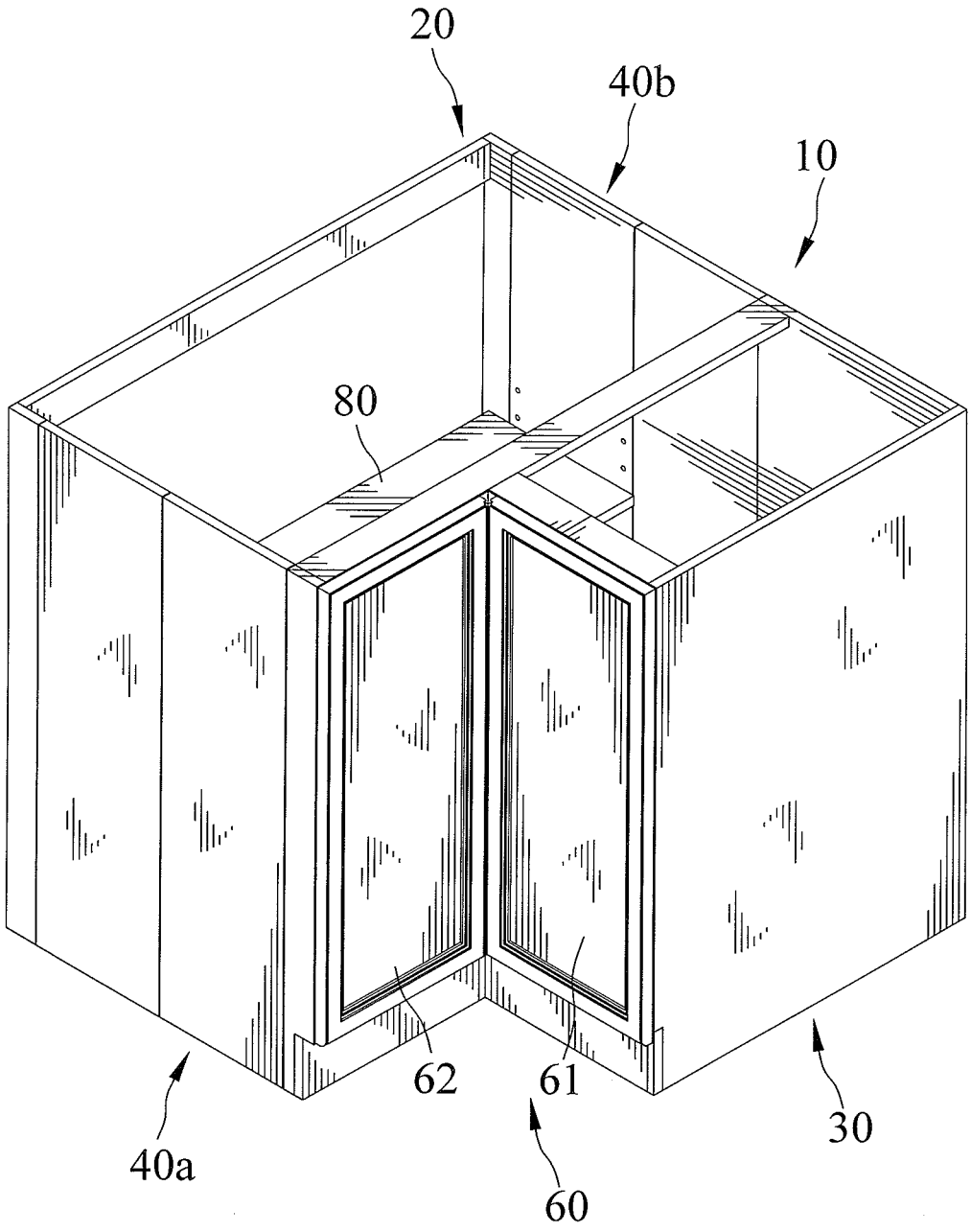
FIG. 1 is a perspective view of a lower corner cabinet in accordance with the present invention, with the lower corner cabinet positioned in an extended position.
Figure 2:
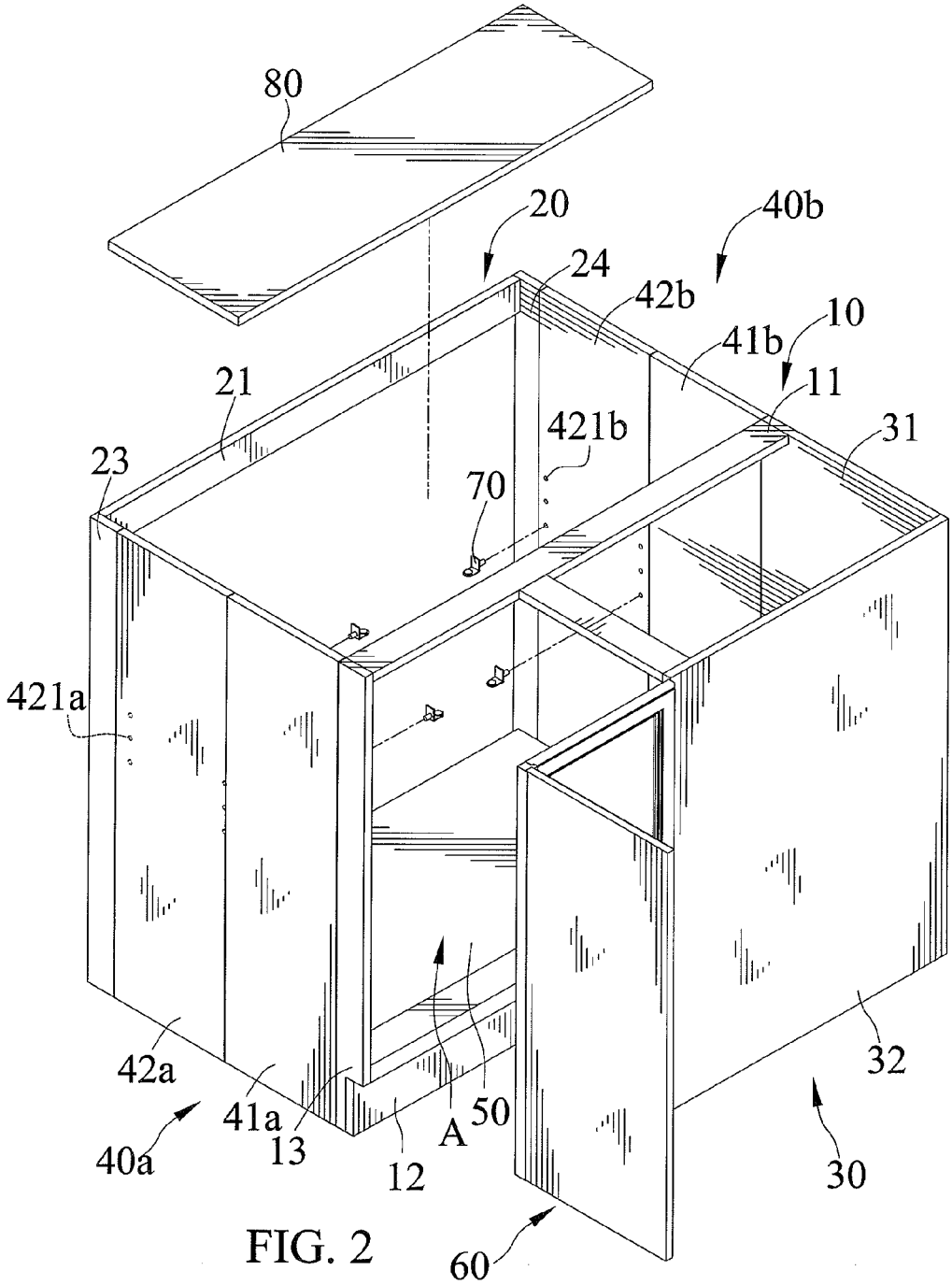
FIG. 2 is an exploded perspective view of the lower corner cabinet of FIG. 1.
Figure 3:
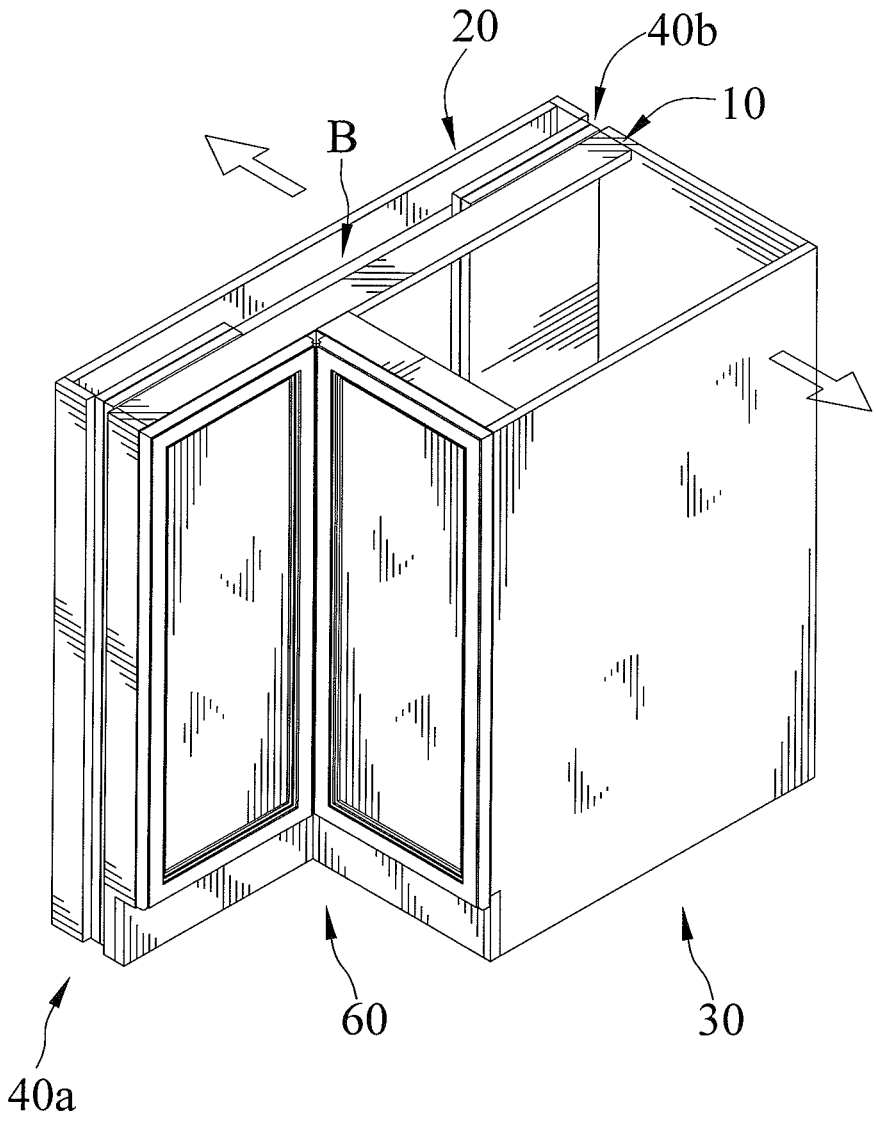
FIG. 3 is a perspective view of the lower corner cabinet of FIG. 1, with the lower corner cabinet positioned in a collapsed position.
Figure 4:
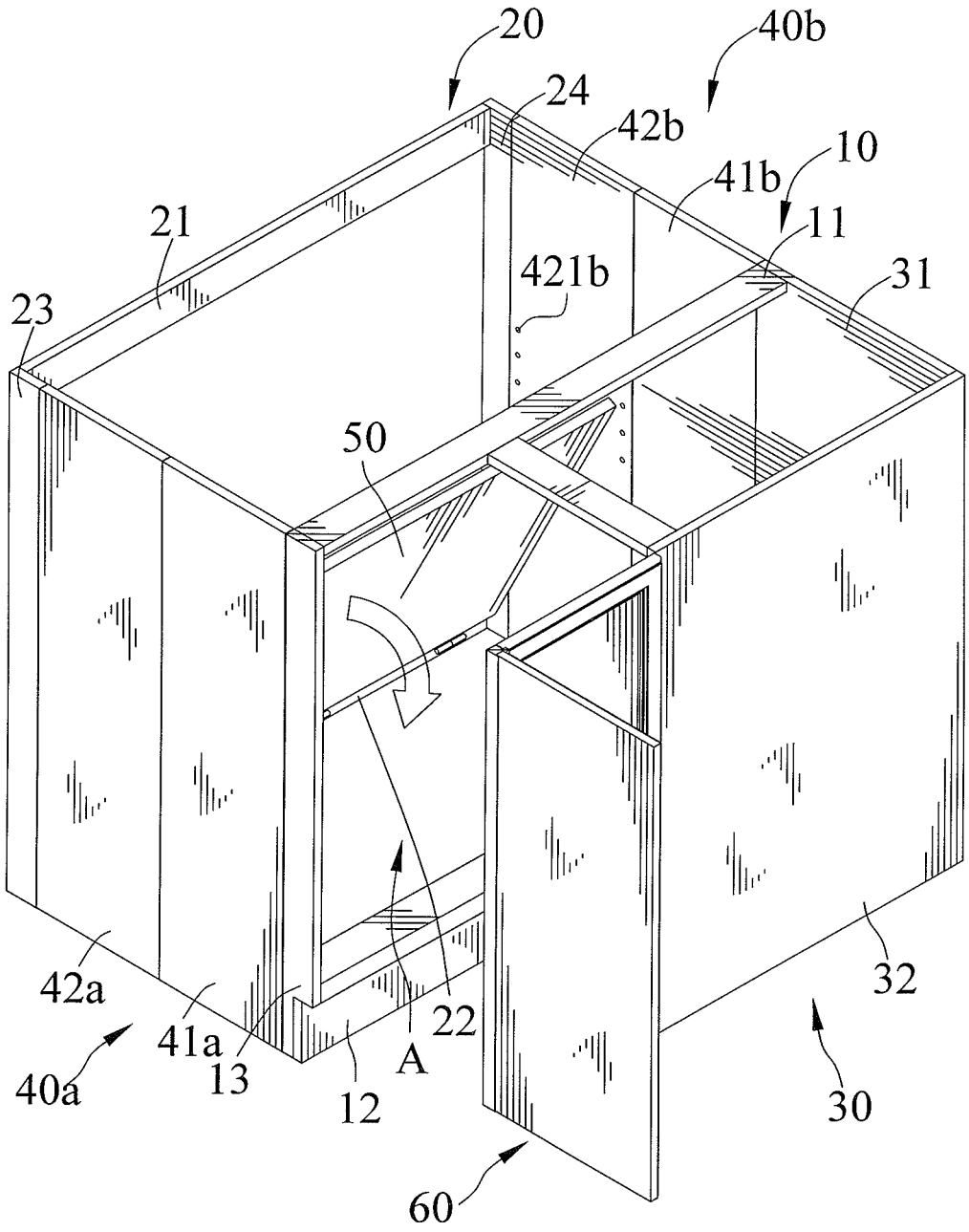
FIG. 4 is another exploded perspective view of the lower corner cabinet of FIG. 1 and shows the lower corner cabinet including bottom and door panels in different positions than that of FIG. 1.
Figure 5:
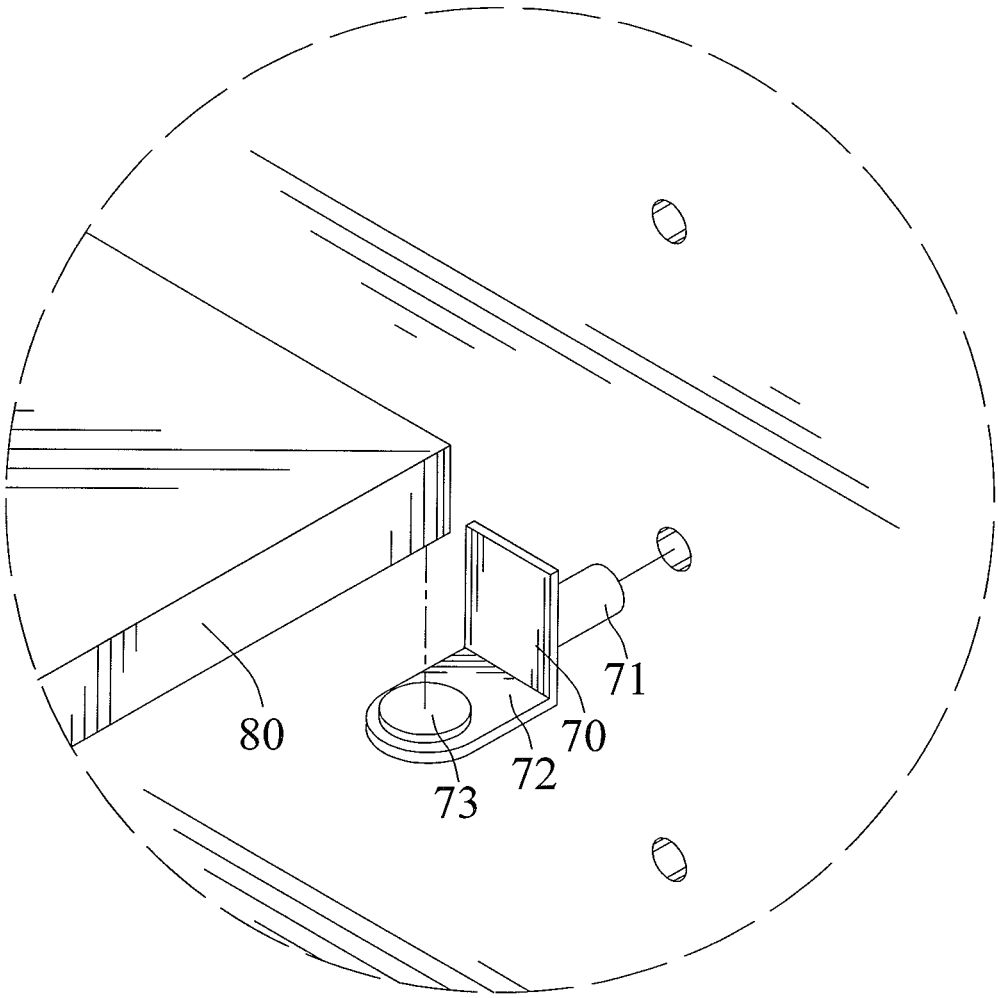
FIG. 5 shows the lower corner cabinet of FIG. 1 including at least one stud for supporting the shelf.

FIGS. 1 through 5 show a lower corner cabinet in accordance with the present invention. The lower corner cabinet includes front and rear frames 10 and 20, front panel 30, first and second lateral panels 40*a* and 40*b*, a bottom panel 50, and a door panel 60.

The front frame 10 includes a configuration including first, second, and third extensions 11, 12, and 13. The first and second extensions 11 and 12 are disposed opposite to and separated from each other. The third extension extends from the first extension 11 to the second extension 12. The first extension 11 includes a configuration including first and second structures. The first and second structures extend transversely to each other. The second extension includes a configuration including third and fourth structures. The third and fourth structures extend transversely to each other.

The rear frame 20 is separated from and disposed behind the front frame 10. The rear frame 20 includes a configuration including first, second, third, and fourth sides 21, 22, 23, and 24. The first and second sides 21 and 22 are disposed opposite to each other. Each of the third and fourth sides 23 and 24 extends from the first side 21 to the second side 22. The bottom panel 12 is pivotally joined to the second side 22.

The front panel 30 extends from and disposed in front of the front frame 10. The front panel 30 includes a configuration including first and second sections 31 and 32. The first and second sections 31 and 32 have a common edge and extend transversely to each other. Additionally, the first structure of first extension 11 includes a distal end abutted against the first section 31 and the second structure of first extension 11 includes a distal end abutted against the second section 32 and the fourth structure of the second extension 12 includes a distal end abutted against the second section 32, respectively.

The first lateral panel 40*a* is pivotally joined to the third extension 13. The first lateral panel 40*a* extends from the front frame 10 to the rear frame 20. The first lateral panel 40*a* includes an end pivotally joined to the front frame 10 and another end pivotally joined to the rear frame 20. Moreover, the first lateral panel 40*a* is pivotally joined to the third side 23. The first lateral panel 40*a* is foldable. The first lateral panel 40*a* further includes a configuration including first and second boards 41*a* and 42*a*. The first and second boards 41*a* and 42*a* are pivotally joined together. The first board 41*a* is pivotally joined to the third extension 13 and the second board 42*a* is pivotally joined to the third side 23 of the rear frame 20 respectively. Further, a plurality of first apertures 421*a* is defined in the first lateral panel 40*a*. The plurality of first apertures 421*a* are disposed one next to another in a spaced relationship, and distances defined between any two adjacent first apertures 421*a* equal to each other.

The second lateral panel 40*b* is separated from the first lateral panel 40*a*. The second lateral panel 40*b* extends from the front frame 10 to the rear frame 20. The second lateral panel 40*b* includes an end pivotally joined to the front panel 30, i.e., the first section 31 and another end pivotally joined to the rear frame 20. Moreover, the second lateral panel 40*b* is pivotally joined to the fourth side 24. The second lateral panel 40*b* is foldable. The second lateral panel 40*b* further includes a configuration including third and fourth boards 41*b* and 42*b*. The third and fourth boards 41*b* and 42*b* are pivotally joined together. The third board 41*b* is pivotally joined to the first section 31 of the front panel 30 and the fourth board 42*b* is pivotally joined to the fourth side 24 of the rear frame 20 respectively. Further, a plurality of second apertures 421*b* is defined in the second lateral panel 40*b*. The plurality of second apertures 421*b* are disposed one next to another in a spaced relationship, and distances defined between any two adjacent second apertures 421*b* equal to each other.

The bottom panel 50 is selectively abutted against the front and rear frames 10 and 20 and the first and second lateral panels 40*a* and 40*b*. The bottom panel 50 is pivotally movable.

The door panel 60 extends from the front panel 30 to the front frame 10. The door panel 60 is pivotally movable and pivotally joined to second panel 32. The door panel 60 is foldable and includes a configuration including first and second segments 61 and 62. The first and second segment 61 and 62 are pivotally joined to each other and include a common edge. Additionally, the lower corner cabinet includes an opening delimited by the first and second structure of the first extension 11, the third and fourth structures of the second extension 12, the third extension 13, and the second section 32 of the front panel 30. The opening is selectively closed by the door panel 60.

The lower corner cabinet is operable in an extended position and a collapsed position and able to be operably changed therebetween without the aid of a tool.

The lower corner cabinet includes a room including a periphery delimited by the front and rear frames 10 and 20 as well as the first and second lateral panels 40*a* and 40*b*. Objects to be stored in the lower corner cabinet is adapted to be disposed in the room. The lower corner cabinet positioned in the extended position includes the room having a reference A having a first size. The room A has a rectangular cross section. The lower corner cabinet positioned in the collapsed position includes the room having a reference B having a second size. The second size is smaller than the first size.

The lower corner cabinet positioned in the extended position includes a first frontal area. The lower corner cabinet positioned in the collapsed position includes a second frontal area. The second frontal equals to the first frontal area.

The lower corner cabinet positioned in the extended position includes the room including a shelf 80 selectively received therein and supported at a height. Each of the plurality of first and second apertures 421*a* and 421*b* includes a stud 70 selectively engaged therein for supporting the shelf at the height. The stud 70 includes a configuration including an engaging portion 71 and a supporting portion 72. Each of the plurality of first and second apertures 421*a* and 421*b* having the stud 70 engaged therein receives the engaging portion 72 of the stud 70 and includes the supporting portion 71 exposed thereoutside. The supporting portion 72 includes a configuration including first and second walls. The first and second walls have a common edge and extend in an angled relationship. The stud 70 further includes the supporting portion 72 including an anti-slip portion 73 extended thereon. The stud 70 supporting the shelf 80 includes the shelf 80 in frictional contact with the anti-slip portion 73.

The lower corner cabinet positioned in the extended position includes the first section 31 of the front panel 30 and the third and fourth boards 41*b* and 42*b* of the second lateral panel 40 aligned together and includes the first and second boards 41*a* and 42*a* of the first lateral panel 40*a* aligned together and includes the first and second boards 41*a* and 42*a* extending in a first direction and the third and fourth boards 41*b* and 42*b* extending in a second direction parallel to the first direction. The lower corner cabinet positioned in the collapsed position includes the first and second boards 41*a* and 42*a* of the first lateral panel 40*a* overlapped and extending parallel to each other and includes the third and fourth boards 41*b* and 42*b* of the second lateral panel 40*b* overlapped and extending parallel to each other.

The lower corner cabinet positioned in the extended position includes the front and rear frames 10 and 20 disposed opposite to each other. The lower corner cabinet positioned in the collapsed position includes the front and rear frames 10 and 20 disposed opposite to each other. The lower corner cabinet positioned in the collapsed position includes the front and rear frames 10 and 20 operably movable in opposite directions until positioned in the extended position.

While the specific embodiment has been illustrated and described, numerous modifications come to mind without significantly departing from the spirit of invention, and the scope of invention is only limited by the scope of the accompanying claims.

What is claimed is:

1. A lower corner cabinet comprising:

a front frame;

a rear frame separated from and disposed behind the front frame;

a front panel extending from and disposed in front of the front frame;

a first lateral panel extending from the front frame to the rear frame and including an end pivotally joined to the front frame and another end pivotally joined to the rear frame and being foldable;

a second lateral panel separated from the first lateral panel and extending from the front frame to the rear frame and including an end pivotally joined to the front panel and another end pivotally joined to the rear frame and being foldable;

a bottom panel selectively abutted against the front and rear frames and the first and second lateral panels and being pivotally movable; and a door panel extending from the front panel to the front frame and being pivotally movable;

wherein the lower corner cabinet is operable in an extended position and a collapsed position and able to be operably changed therebetween without the aid of a tool, with the lower corner cabinet including a room including a periphery delimited by the front and rear frames as well as the first and second lateral panels, with the lower corner cabinet positioned in the extended position including the room having a first size, with the lower corner cabinet positioned in the collapsed position including the room having a second size, with the second size smaller than the first size.

2. The lower corner cabinet as claimed in claim 1, wherein the front frame includes a configuration including first, second, and third extensions, with the first and second extensions disposed opposite to and separated from each other, with the third extension extending from the first extension to the second extension, with the first extension including a configuration including first and second structures, with the first and second structures extending transversely to each other, with the second extension including a configuration including third and fourth structures, with the third and fourth structures extending transversely to each other, wherein the first lateral panel is pivotally joined to the third extension.

3. The lower corner cabinet as claimed in claim 2, wherein the rear frame includes a configuration including first, second, third, and fourth sides, with the first and second sides disposed opposite to each other, with each of the third and fourth sides extending from the first side to the second side, wherein the bottom panel is pivotally joined to the second side, wherein the first lateral panel is pivotally joined to the third side the second lateral panel is pivotally joined to the fourth side respectively.

4. The lower corner cabinet as claimed in claim 3, wherein the front panel includes a configuration including first and second sections, with the first and second sections having a common edge and extending transversely to each other, wherein the first structure of first extension includes a distal end abutted against the first section, wherein the second structure of first extension includes a distal end abutted against the second section, wherein the fourth structure of the second extension includes a distal end abutted against the second section, wherein the second lateral panel is pivotally joined to the first section, wherein the door panel is pivotally joined to the second section.

5. The lower corner cabinet as claimed in claim 4, wherein the first lateral panel includes a configuration including first and second boards, with the first and second boards pivotally joined together, with the first board pivotally joined to the third extension and the second board pivotally joined to the third side of the rear frame respectively, wherein the second lateral panel includes a configuration including third and fourth boards, with the third and fourth boards pivotally joined together, with the third board pivotally joined to the first section of the front panel and the fourth board pivotally joined to the fourth side of the rear frame respectively.

6. The lower corner cabinet as claimed in claim 5, wherein the lower corner cabinet positioned in the extended position includes the first section of the front panel and the third and fourth boards of the second lateral panel aligned together and includes the first and second boards of the first lateral panel aligned together and includes the first and second boards extending in a first direction and the third and fourth boards extending in a second direction parallel to the first direction.

7. The lower corner cabinet as claimed in claim 1, wherein the first lateral panel includes a plurality of first apertures defined therein, wherein the second lateral panel includes a plurality of second apertures defined therein, wherein the lower corner cabinet positioned in the extended position includes the room including a shelf selectively received therein and supported at a height, wherein each of the plurality of first and second apertures includes a stud selectively engaged therein for supporting the shelf at the height.

8. The lower corner cabinet as claimed in claim 7, wherein the stud includes a configuration including an engaging portion and a supporting portion, wherein each of the plurality of first and second apertures having the stud engaged therein receives the engaging portion of the stud and includes the supporting portion exposed thereoutside.

9. The lower corner cabinet as claimed in claim 8, wherein the plurality of first apertures are disposed one next to another in a spaced relationship, with distances defined between any two adjacent first apertures equaling to each other, wherein the plurality of second apertures are disposed one next to another in a spaced relationship, with distances defined between any two adjacent second apertures equaling to each other.

10. The lower corner cabinet as claimed in claim 8, wherein the stud includes the supporting portion including a configuration including first and second walls, with the first and second walls having a common edge and extending in an angled relationship.

11. The lower corner cabinet as claimed in claim 10, wherein the stud includes the supporting portion including an anti-slip portion extended thereon, wherein the stud supporting the shelf includes the shelf in frictional contact with the anti-slip portion.

12. The lower corner cabinet as claimed in claim 4, wherein the door panel is foldable and includes a configuration including first and second segments, with the first and second segment pivotally joined to each other and including a common edge, wherein the lower corner cabinet includes an opening delimited by the first and second structure of the first extension, the third and fourth structures of the second extension, the third extension, and the second section of the front panel, wherein the opening is selectively closed by the door panel.

13. The lower corner cabinet as claimed in claim 1, wherein the lower corner cabinet positioned in the extended position includes a first frontal area, wherein the lower corner cabinet positioned in the collapsed position includes a second frontal area, with the second frontal equaling to the first frontal area.

14. The lower corner cabinet as claimed in claim 6, wherein the lower corner cabinet positioned in the collapsed position includes the first and second boards of the first lateral panel overlapped and extending parallel to each other and includes the third and fourth boards of the second lateral panel overlapped and extending parallel to each other.

15. The lower corner cabinet as claimed in claim 14, wherein the lower corner cabinet positioned in the extended position includes the front and rear frames disposed opposite to each other, wherein the lower corner cabinet positioned in the collapsed position includes the front and rear frames disposed opposite to each other, wherein the lower corner cabinet positioned in the collapsed position includes the front and rear frames operably movable in opposite directions until positioned in the extended position.

* * * * *